United States Patent [19]

Dean

[11] 4,382,627

[45] May 10, 1983

[54] CONVERTIBLE PICNIC TABLE AND BENCH

[76] Inventor: Leonard F. Dean, Rte. 2, P.O. Box 580, Bainbridge, Ga. 31717

[21] Appl. No.: 165,859

[22] Filed: Jul. 7, 1980

[51] Int. Cl.[3] ..... A47C 13/00

[52] U.S. Cl. ..... 297/124; 297/121; 297/159

[58] Field of Search ..... 297/125, 126, 127, 128, 297/124, 121, 123, 159, 157, 143

[56] References Cited

U.S. PATENT DOCUMENTS

| | | | |
|---|---|---|---|
| 1,238,354 | 8/1917 | South | 297/125 |
| 1,255,764 | 2/1918 | Macon | 297/125 |
| 2,618,314 | 11/1952 | Jerdee | 297/121 |
| 2,757,713 | 8/1956 | Jerdee | 297/121 |

FOREIGN PATENT DOCUMENTS

| | | | |
|---|---|---|---|
| 918154 | 10/1946 | France | 297/143 |

*Primary Examiner*—James T. McCall

*Attorney, Agent, or Firm*—Newton, Hopkins & Ormsby

[57] ABSTRACT

Table top support arms are pivoted to a base frame and extend above and below it. The lower ends of the support arms are connected through linkages with picnic table bench sections having sliding engagement with the base frame. When the support arms are tilted in one direction on their pivots, the linkage draws the bench sections together to produce a single bench bottom and the table top which is pivotally supported on the support arms is swung to a back rest forming position. Stop elements on the support arms limit the swing of the support arms and also position the back rest and table top component.

10 Claims, 7 Drawing Figures

CONVERTIBLE PICNIC TABLE AND BENCH

BACKGROUND OF THE INVENTION

This invention relates to convertible furniture and more particularly to a convertible picnic table and bench which is characterized by simplicity and convenience of construction and operation, strength and durability, and comparative low cost of manufacture. In one mode of use, a broad horizontal picnic table top is supported stably between two parallel bench sections at an elevation below the table top and being coextensive lengthwise therewith. In a second mode of use, the two bench sections move together horizontally to form a broad continuous bench or seat bottom and the top of the table assumes a stable inclined position above the bench bottom to serve as a back rest.

While convertible furniture of various types is known in the prior art, no known prior art structure possesses the construction and mode of operation of the present invention or satisfies the need in the art which the present invention seeks to satisfy. On small home patios or porches and on the balconies of high rise apartments, there is a genuine need for a convertible furniture unit of this type and the prior art cannot satisfy this need in any practical or attractive manner.

Other features and advantages of the invention will become apparent during the course of the following detailed description.

DETAILED DESCRIPTION

Figure 1:
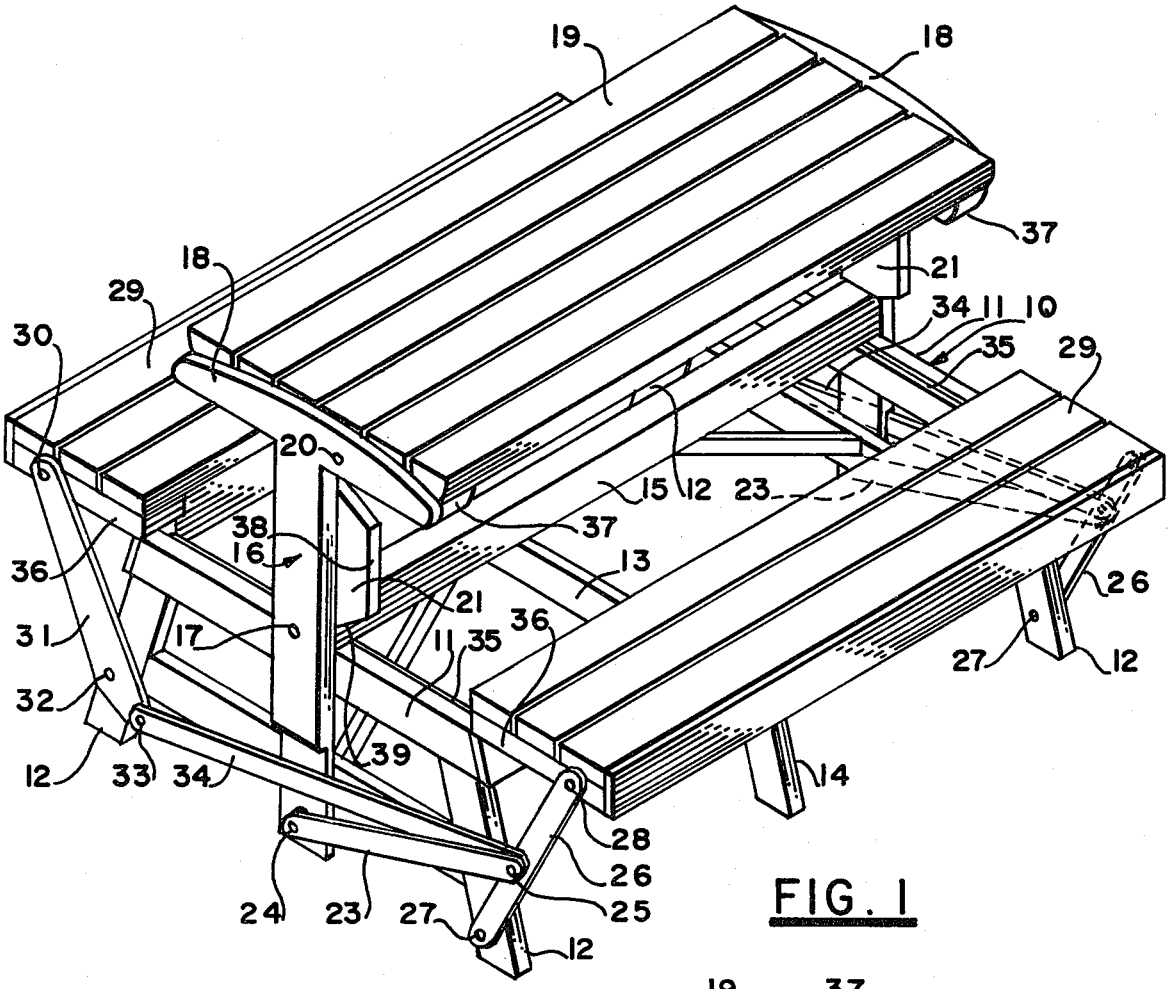
FIG. 1 is a perspective view of a convertible picnic table and bench in accordance with the invention arranged in the table mode of use.

Referring to the drawings in detail wherein like numerals designate like parts, a horizontal base or support frame 10 including side rails 11 carries corner legs 12 fixed to the support frame so as to form a rigid unit. The support frame 10 may include an intermediate beam 13 and intermediate legs 14, FIG. 1, if desired, as well as conventional bracing.

A sturdy beam 15 is fixed to the tops of side members 11 at the center of the support frame 10 and extends for the full width of the support frame with the opposite ends of the beam 15 flush with the outer faces of side members 11.

T-shaped support arms 16 are pivotally secured through pivot elements 17 to the end faces of beam 15 with the arms 16 lying immediately outside of the members 11. The arms 16 extend for substantial distances above and below their pivots 17, and at their tops include substantially right angular heads or cross members 18 of rigid construction to complete the T-formation of the pivoted arms.

A full width picnic table top 19, which may be of slatted construction, also adapted to form a back rest, is pivotally connected by pivot elements 20 to the cross members 18 beyond one side of the upright members of the arms 16. Platelike stop elements 21 fixed to the inner faces of the arms 16 immediately below cross members 18 include support surfaces 22 for the table top 19 to stabilize the latter in a horizontal use position, FIG. 2.

Near the bottoms of the pivoted support arms 16 on both sides of the assembly, links 23 have corresponding ends pivotally connected at 24 to the arms 16 and have their other ends pivotally attached at 25 to bench section drive links 26. These latter links are pivoted at 27 to the adjacent legs 12 of support base 10 and are further pivoted at 28 to the opposite ends of a picnic table bench section 29.

A companion bench section 29 on the opposite side of the structure is pivotally attached at each end by pivot elements 30 to rocker links 31 pivotally attached at 32 to the adjacent legs 12. Corresponding ends of the rocker links 31 are pivotally attached at 33 to elongated connecting links 34, whose opposite ends are attached to the pivot elements 25. The described linkages interconnecting the arms 16 and picnic table bench sections 29 at opposite sides of the structure are mirror images of each other and operate in unison during conversion of the device from a picnic table to a bench and vice-versa.

The bench sections 29 are at a common elevation below the table top 19 and rest slidingly on support frame 10 whose side members 11 are notched in their tops as shown at 35, FIG. 6, to interfit with runners 36 on the bottoms of bench sections 29 at their opposite ends. This interfitting relationship of the runners 36 with side members 11 assures proper guidance of the bench sections 29 in response to operation of their driving linkages when the arms 16 are tilted on their pivots 17. During this action, the bench sections 29 may slide from their fully separated positions in FIG. 2 through the intermediate position of FIG. 3 to their single bench or seat-forming positions in FIGS. 4 and 5. It should be noted that in this latter position the two bench sections 29 substantially contact the opposite longitudinal sides of beam 15 and are flush with the top face of this beam, FIG. 4, to form a continuous horizontal wide seat or bench bottom.

Figure 3:
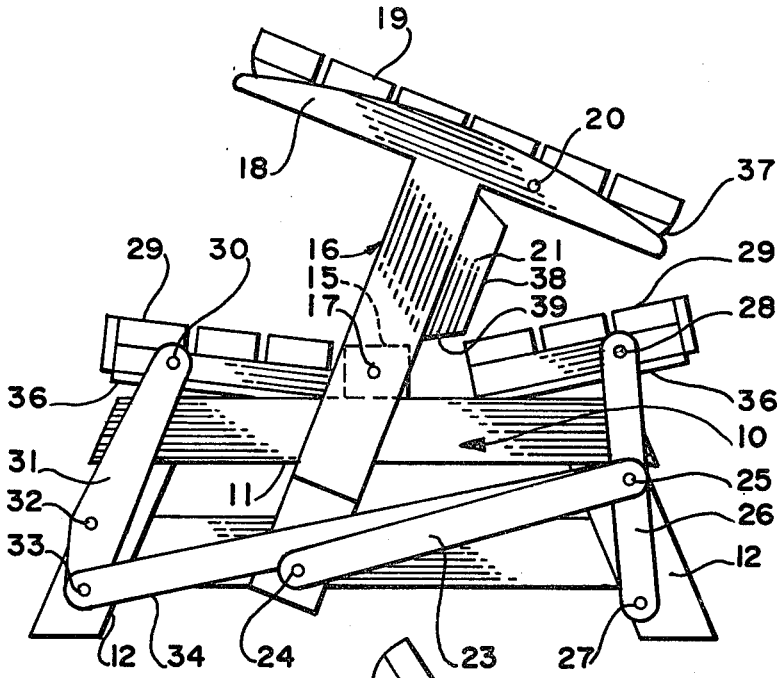
FIGS. 3, 4 and 5 are further side elevations depicting the conversion of the picnic table into a bench.
Figure 4:
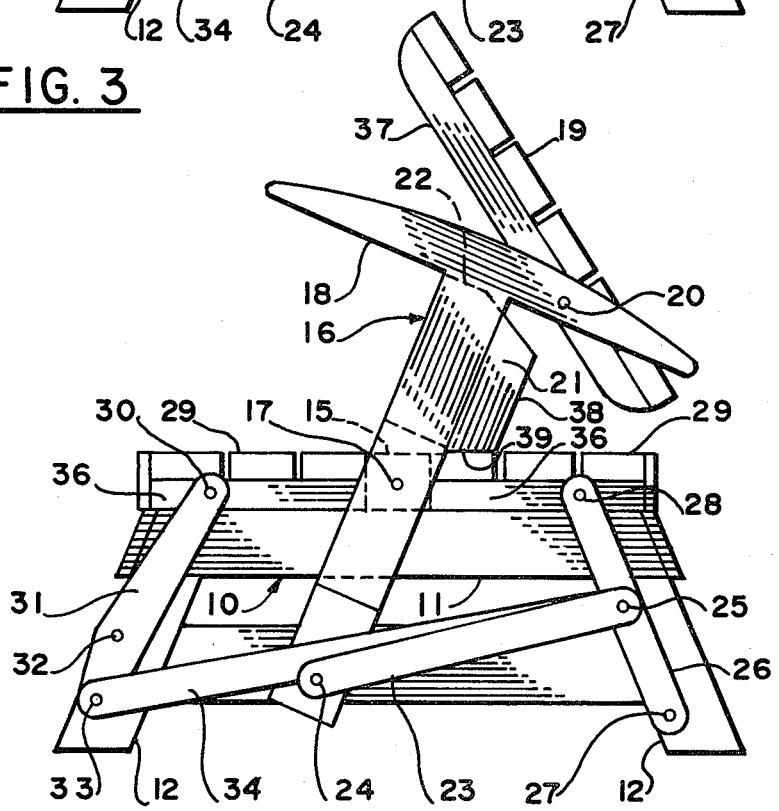
Figure 5:
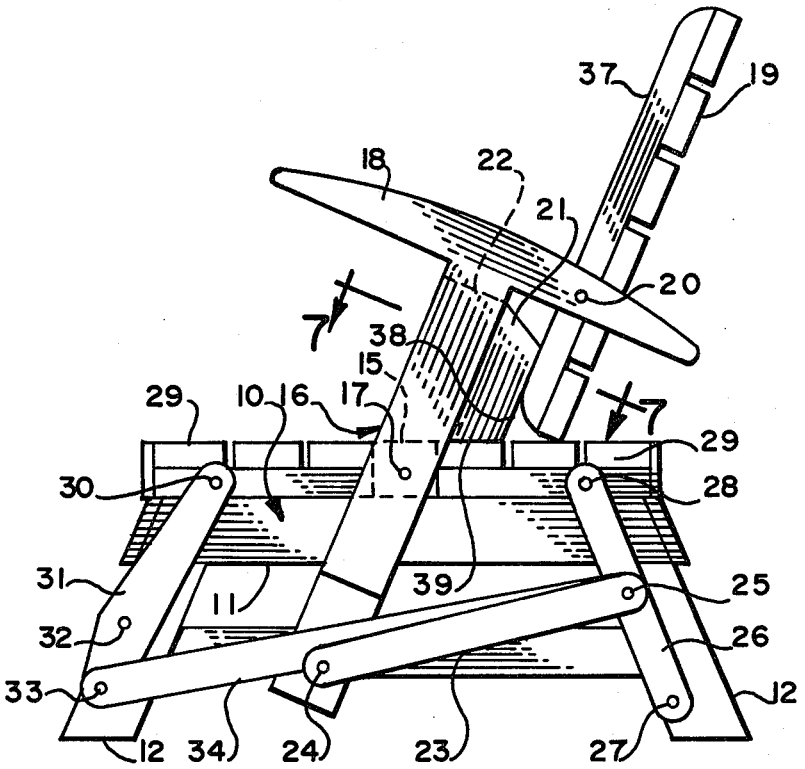
Figure 6:
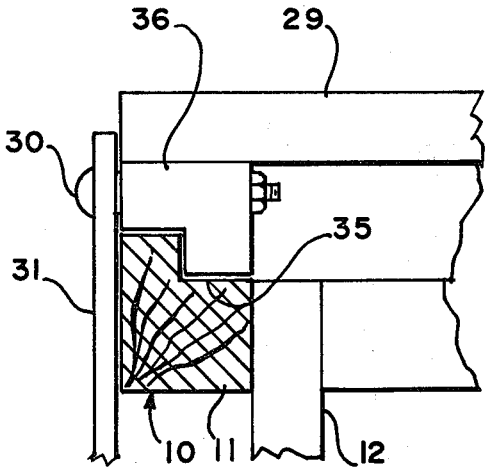
FIG. 6 is an enlarged fragmentary vertical section taken on line 6—6 of FIG. 2.
Figure 7:
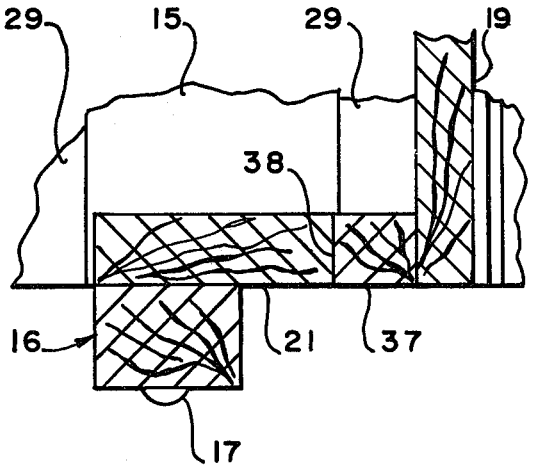
FIG. 7 is an enlarged sectional view taken on line 7—7 of FIG. 5.

After the support arms 16 have been tilted, as shown in FIGS. 3 through 5, to convert the picnic table of FIG. 1 to the bench shown in the intermediate position of FIG. 4, table top 19 is swung on its pivots 20 to the final back rest position shown in FIG. 5. In such position, side rails 37 of the combined table top-back rest 19 abut projecting edges 38 of stop elements 21 to stabilize the back rest in its use position. Similarly, other edges 39 of stop elements 21 engage the top face of bench section 29, as shown in FIGS. 4 and 5, to positively limit the tilting movement of the arms 16 in their bench conversion positions. Thus it may be seen that the stop elements 21 are key elements of the invention which positively position the component 19 in its two positions of use and also limit the travel of the pivoted support arms 16.

Figure 2:
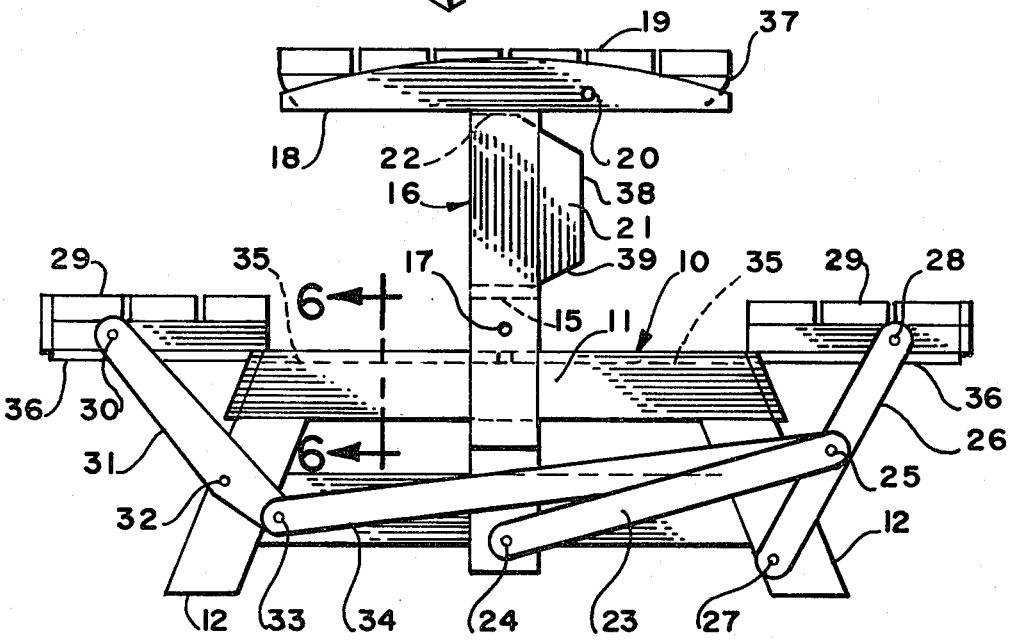
FIG. 2 is a side elevation of the invention in FIG. 1.

In converting the picnic table shown in FIGS. 1 and 2 to the bench shown in FIG. 5, it is merely necessary to tilt the pivoted arms 16 on their pivots 17 clockwise as viewed in FIGS. 2 through 5. Such movement through the links 23, 26, 34 and 31 shifts bench sections 29 toward each other and through the transition position shown in FIG. 3 until the bench sections substantially contact the beam 15 and the stop surface 39 abuts bench section 29. Following this, the component 19 is swung to the back rest position of FIG. 5 in contact with stop faces 38. The structure is reliable, simplified and convenient to operate. It is also rugged and durable and inexpensive to manufacture. It should be noted that cross members 18 of arms 16 form arm rests at opposite sides of the bench shown in FIG. 5.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A convertible picnic table and bench comprising a central supporting base having opposed spaced sides, and beam means joining said sides, a pair of arms respectively pivotally mounted on outwardly of the outer surfaces of said sides, said arms being swingable relative to and outwardly of the base in substantially vertical planes, a pair of bench sections moveably engaging the supporting base on opposite sides of said arms, driving connecting means between said arms and bench sections operable to shift the bench sections toward and away from each other in unison responsive to swinging movement of said arms on said base said bench sections being receivable by their edges, on the upper surfaces of said sides when said bench sections are adjacent to each other, a combined table top and back rest element pivotally attached to and carried by the outer end portions of said arms above the supporting base and bench sections, said combined top and back rest element being bodily movable with said arms relative to the supporting base, and a stop element fixed to at least one of said arms and including stop surfaces engageable with said combined table top and back rest element to position it selectively in a table top or back rest position relative to the arms and said bench sections, said stop element having another stop surface engageable with an opposing fixed surface to limit swinging of said arms in one direction.

2. A convertible picnic table and bench comprising a supporting base, a pair of arms pivoted to opposite outer sides of said base and being swingable vertically relative to said base, a pair of parallel bench sections below the tops of said arms slidably engaging the supporting base and being shiftable toward and away from each other said bench sections being supported by its edges on said base when said bench sections are in positions shifted toward each other, the inner edges of said bench sections resting upon the outer edge portions of said base when said bench sections are in positions shifted away from each other, drive linkage means for said bench sections connected therewith and connected with the supporting base and said arms, a panel member adapted to serve as a table top and back rest pivoted to the tops of said arms and bodily carried thereby, and rigid stop means on said arms limiting their swinging movement at least in one direction and including surfaces engaging said panel member to stabilize it in the table top and back rest positions.

3. A convertible picnic table and bench as defined in claim 1, wherein said arms are substantially T-shaped and said combined table top and back rest element is pivoted to the cross members of said arms on one side of their upright portions, said cross members forming inclined arm rests when said combined table top and back rest element is in the back rest position.

4. A convertible picnic table and bench as defined in claim 1, wherein said bench sections are parallel and have sliding engagement with a horizontal surface of the supporting base.

5. A convertible picnic table and bench as defined in claim 4, and said supporting base including notched side members forming guide tracks, and interfitting runners on said bench sections interfitting slidably with said notched side members.

6. A convertible picnic table and bench as defined in claim 1, and said driving connecting means comprising linkages on opposite sides of the supporting base pivotally coupled therewith and pivotally coupled with the bench sections and with said arms whereby tilting of the arms in one common direction on their pivots will cause the bench sections to slide together on the supporting base and form a continuous horizontal seat surface.

7. A convertible picnic table and bench as defined in claim 6, and a beam extending across the top of the supporting base at the center thereof, said arms being pivoted to the opposite end faces of the beam, and the interior edges of the bench sections substantially abutting the opposite side of said beam when the bench sections at their innermost positions on the supporting base forming said seat surface, the top faces of the bench sections then being flush with the top surface of said beam.

8. A convertible picnic table and bench as defined in claim 6, and each linkage comprising a first link pivotally attached to one of said arms, a second link pivotally attached to the supporting base and to one bench section and having a pivotal connection with the first link between the ends of the second link, a third link pivotally attached to the second link, and a fourth link pivotally attached to the third link and with said supporting base and having a pivotal connection with the other bench section.

9. A convertible picnic table and bench as defined in claim 2, and said rigid stop means comprising a pair of plate members on the interior sides of said arms above side members of the supporting base and being in the path of movement of the panel member.

10. A convertible picnic table and bench as defined in claim 9, and said plate members having marginal edges approximating trapezoids.

* * * * *